United States Patent [19]

Freze

[11] 4,268,247

[45] May 19, 1981

[54] METHOD FOR DRYING FABRICS

[75] Inventor: Benjamin H. Freze, Garden Grove, Calif.

[73] Assignee: Challenge-Cook Bros., Incorporated, Industry, Calif.

[21] Appl. No.: 42,134

[22] Filed: May 24, 1979

[51] Int. Cl.[3] ..... F26B 5/04; F26D 7/04

[52] U.S. Cl. ..... 432/21; 34/15; 34/77; 432/72; 432/105

[58] Field of Search ..... 432/21, 22, 72, 103, 432/105, 43; 34/15, 72, 77

[56] References Cited

U.S. PATENT DOCUMENTS

| | | | |
|---|---|---|---|
| 1,564,566 | 12/1925 | Harris . | |
| 3,157,391 | 11/1964 | Angelone . | |
| 3,205,590 | 9/1965 | Deaton | 432/43 |
| 3,419,969 | 1/1969 | Freze . | |
| 3,601,903 | 8/1971 | Freze . | |
| 3,831,294 | 8/1974 | Freze . | |
| 3,861,865 | 1/1975 | Grantham . | |
| 3,882,613 | 5/1975 | Wilson . | |
| 3,921,308 | 11/1975 | Freze . | |
| 3,995,988 | 12/1976 | Freze | 432/21 |
| 4,010,550 | 3/1977 | Freze . | |
| 4,011,041 | 3/1977 | Taylor | 432/21 |
| 4,038,760 | 8/1977 | Monck et al. | 432/103 |
| 4,065,253 | 12/1977 | Bullock | 432/105 |

FOREIGN PATENT DOCUMENTS

| | | |
|---|---|---|
| 595305 | 12/1947 | United Kingdom . |
| 1243556 | 8/1971 | United Kingdom . |
| 1308335 | 2/1973 | United Kingdom . |
| 1369713 | 10/1974 | United Kingdom . |
| 2031134 | 4/1980 | United Kingdom . |

OTHER PUBLICATIONS

Robert E. Treybal, *Mass-Transfer Operations,* MacGraw Hill, 1955, pp. 530–536.

*Primary Examiner*—John J. Camby
*Attorney, Agent, or Firm*—Lyon & Lyon

[57] ABSTRACT

To dry wet fabrics, a hot drying gas is introduced into a drying chamber containing the fabrics. The drying chamber is maintained at a sufficiently high pressure greater than atmospheric pressure so that a portion of the gas in the drying chamber can be discharged directly to the atmosphere. The remainder of the gas in the drying chamber is withdrawn, and at least a portion of the withdrawn gas is used to produce the hot drying gas introduced into the drying chamber. This is effected by increasing the pressure of the withdrawn gas, heating the withdrawn gas, and combining it with a dilution gas. The amount of the dilution gas which is combined with the withdrawn gas comprises from about 5 to about 20% by volume of the hot drying gas introduced into the drying chamber. Before the withdrawn gas is heated, preferably it is filtered by a lint screen for removal of lint and other contaminants. Novel lint screens capable of self-cleaning during a cooling mode of operation are described.

36 Claims, 12 Drawing Figures

FIG. 2
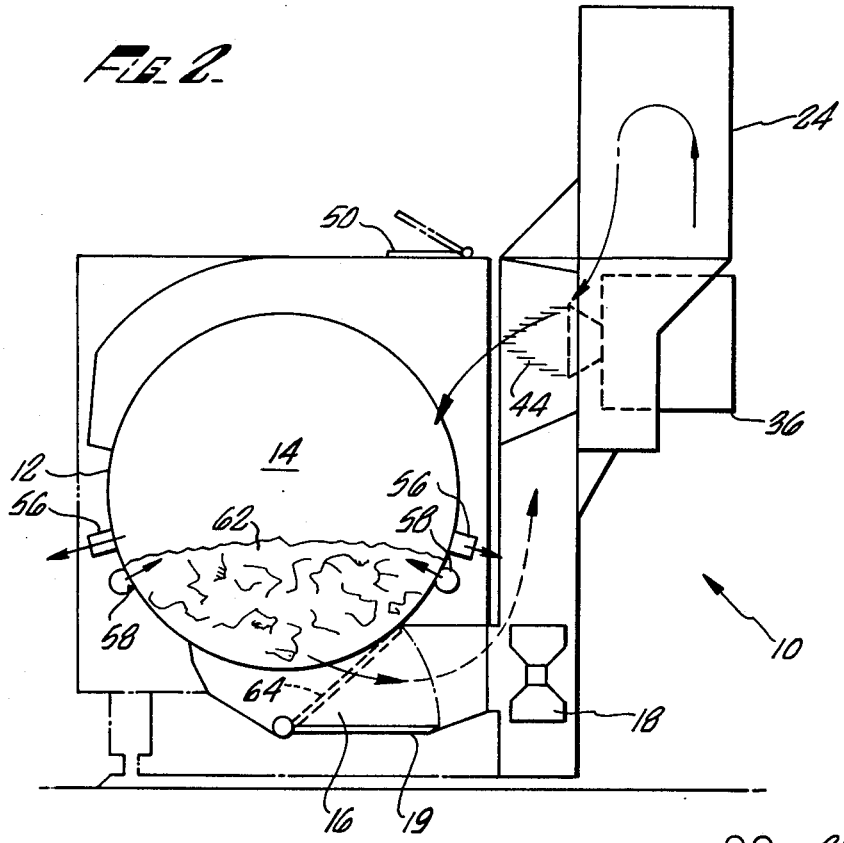
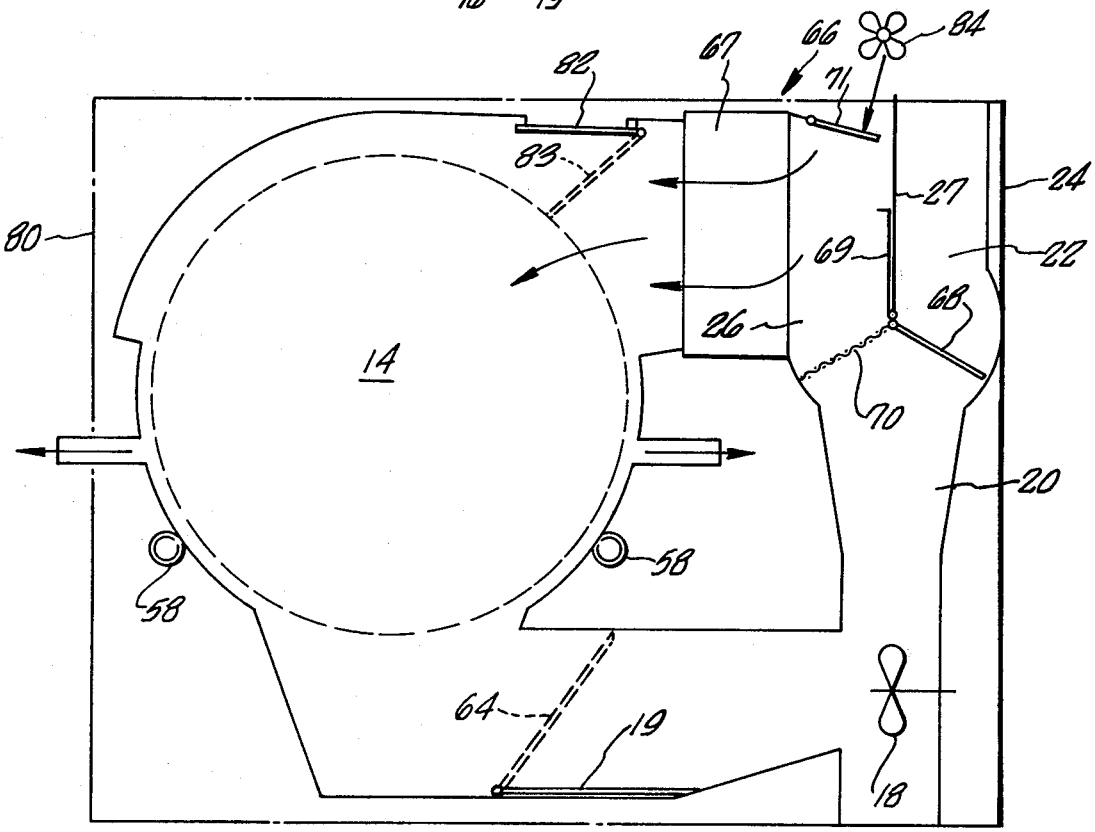
FIG. 5

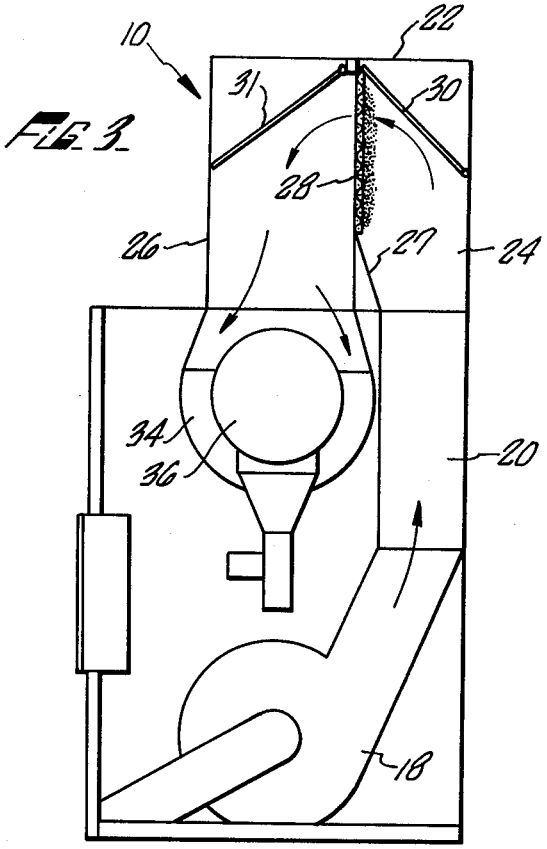
FIG. 3.
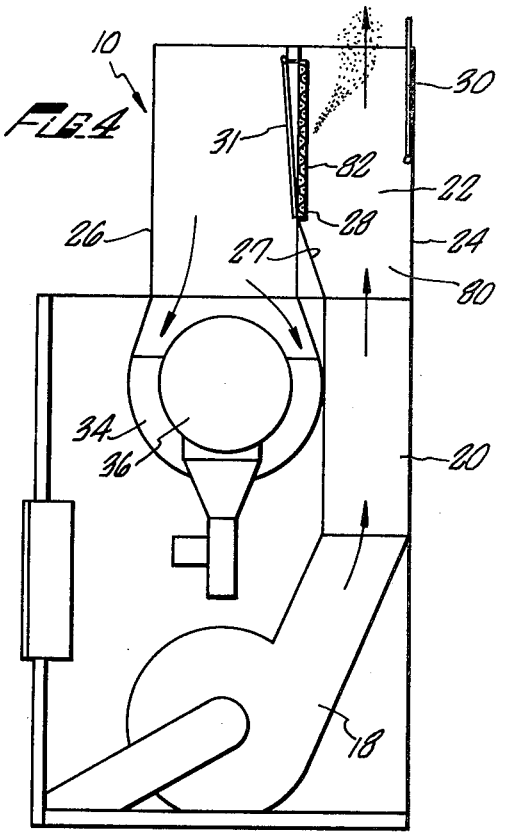
FIG. 4
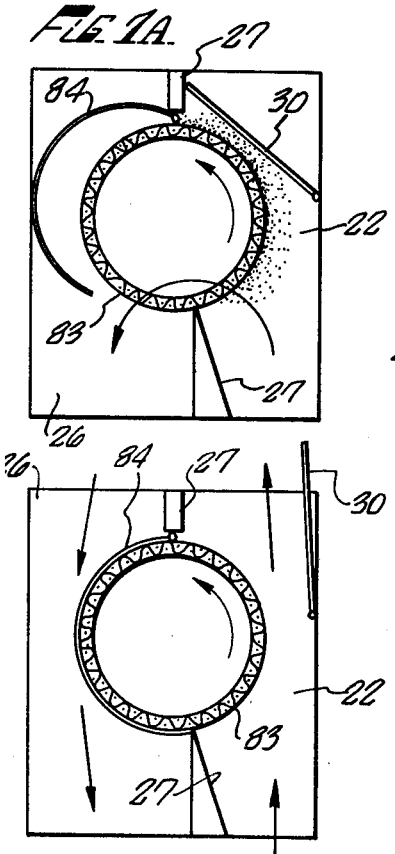
FIG. 1A.
FIG. 1B.
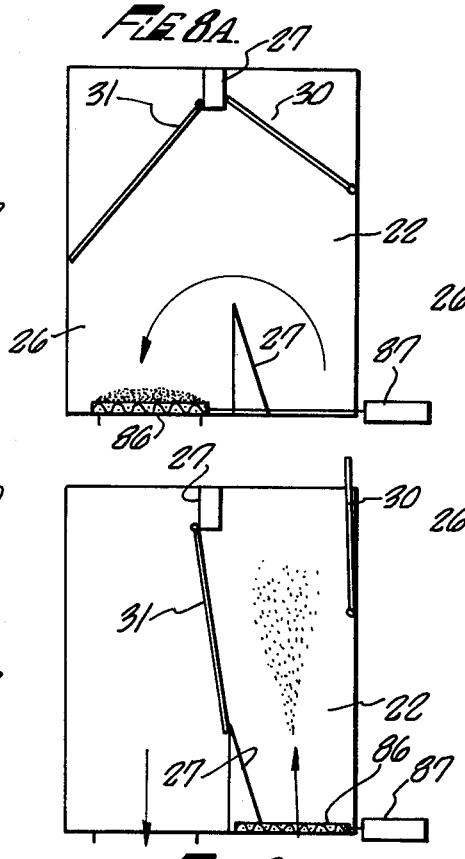
FIG. 8A.
FIG. 8B.
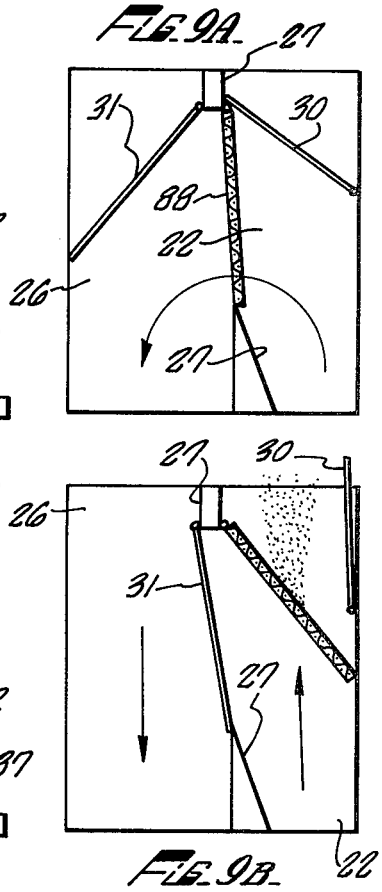
FIG. 9A.
FIG. 9B.

METHOD FOR DRYING FABRICS

BACKGROUND

This invention relates to a method and apparatus for drying fabrics such as textiles.

Large commercial dryers are used for drying fabrics in a variety of applications. For example, such dryers are used by commercial laundries, towel services, diaper services, and textile manufacturers and processors.

Much attention has been directed to improving the performance of such dryers. For example, U.S. Pat. Nos. 1,564,566; 3,157,391; 3,861,865; and 3,882,613 are all directed to improvements in dryers. Also, I have received U.S. Pat. Nos. 3,419,969; 3,601,903; 3,815,257; 3,831,294; 3,921,308; 3,995,988; and 4,010,550, all of which relate to drying of textiles.

Commercially available dryers are able to quickly dry large quantities of fabrics. However, they tend to be inefficient, requiring excessively large quantities of energy for evaporating water from fabrics. Such inefficiency is particularly troublesome for "pass through" systems, where hot gas used for drying the fabrics is discharged to the atmosphere, and not recycled for further drying.

In addition to inefficiency, another problem noted with commercial dryers is uneven drying in the drying chamber. This can result in the bulk of the fabrics in the chamber being dry, with a small portion of the fabrics remaining wet. The drying cycle needs to be lengthened to dry the wet fabrics, and this wastes energy and results in inefficient usage of the drying equipment. It is believed that this problem of uneven drying results from "dead spots" in the drying chamber where introduced drying gas is unable to penetrate and circulate.

Thus, there is a need for an improved drying process and an improved drying apparatus which are more energy efficient than commercially available dryers and which provide more even drying within a drying chamber.

SUMMARY

The present invention is directed to a method and apparatus with the above features. According to the method, a drying gas is formed for introduction into a drying zone containing wet fabrics. The drying gas is maintained at a high temperature of from about 300° to about 600° F. and a low relative humidity of less than about 10%. The pressure of the gas in the drying zone is maintained greater than atmospheric pressure. This has been found to avoid the problem of "dead spots" in the drying zone and permit evaporation of moisture from the fabrics in the drying zone from all surfaces of the fabrics.

A portion of the gas in the drying zone is released directly to the atmosphere. This can occur because the gas in the drying zone is maintained at a pressure greater than atmospheric pressure. The remainder of the gas in the drying zone is withdrawn from the drying zone, and at least a portion of it is recirculated back into the drying zone. Before the withdrawn gas can be recirculated to the drying zone, it is necessary to increase its pressure, heat it, and combine it with a dilution gas to at least replenish what is released from the drying zone to the atmosphere and to reduce the absolute humidity of the withdrawn gas. The amount of dilution gas which is combined with the withdrawn gas comprises from about 5 to about 20% by volume, and preferably only from about 5 to about 10% by volume, of the hot drying gas introduced into the drying zone.

It has been found that this combination of:

(1) positive pressure in the drying zone;

(2) a hot drying gas having a low relative humidity; and (3) recirculation of the bulk of the gas withdrawn from the drying zone results in efficient, uniform, safe, and quick drying of fabrics.

For high efficiency, preferably a direct heating system is used, i.e., the withdrawn gas is directly combined with hot gaseous combustion products of a fuel. These hot combustion products not only raise the temperature of the withdrawn gas, but they also serve as the dilution gas.

An apparatus for practicing this method includes a drying chamber capable of operating at a pressure greater than atmospheric pressure and means for introducing a hot drying gas into the drying chamber. The chamber has outlets for discharging gas directly to the atmosphere and means are provided for withdrawing gas from the drying chamber. To form the hot drying gas from the withdrawn gas, there are provided pump means for increasing the pressure of the withdrawn gas, means for heating the withdrawn gas and means for combining withdrawn gas with a dilution gas.

The means for heating the withdrawn gas and means for combining the withdrawn gas with dilution gas can comprise a burner for combustion of a fuel to produce hot gaseous combustion products and means for combining the withdrawn gas with the hot gaseous combustion products.

Preferably a filter screen is provided for removing and collecting contaminants from withdrawn gas before it is recirculated back into the drying chamber. The filter screen is capable of self-cleaning during a cooling mode or "open loop" drying mode of operation.

DRAWINGS

These and other features, aspects, and advantages of the present invention will become better understood with reference to the following description, appended claims, and accompanying drawings where:

FIG. 1 diagrammatically shows a direct fired dryer, partially cut away, embodying features of the present invention;

FIGS. 2 and 3 diagrammatically show the dryer of FIG. 1 in a drying mode;

FIG. 4 is a view of the dryer of FIG. 1 similar to that of FIG. 3 where the dryer is in a cooling mode or "open loop" drying mode;

FIG. 5 is a view similar to that of FIG. 2 of an indirect fired dryer embodying features of the present invention;

Figure 1:
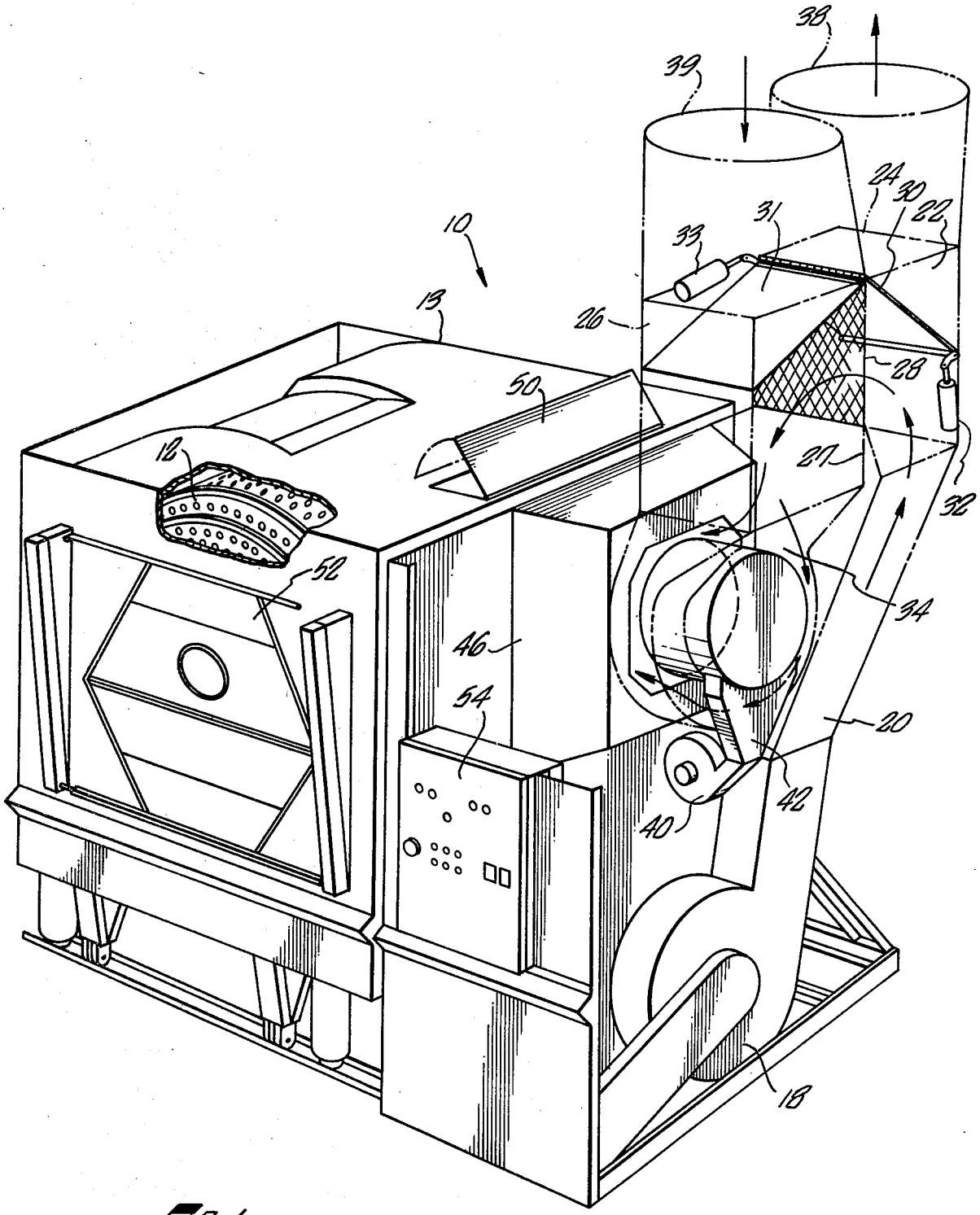
Figure 6:
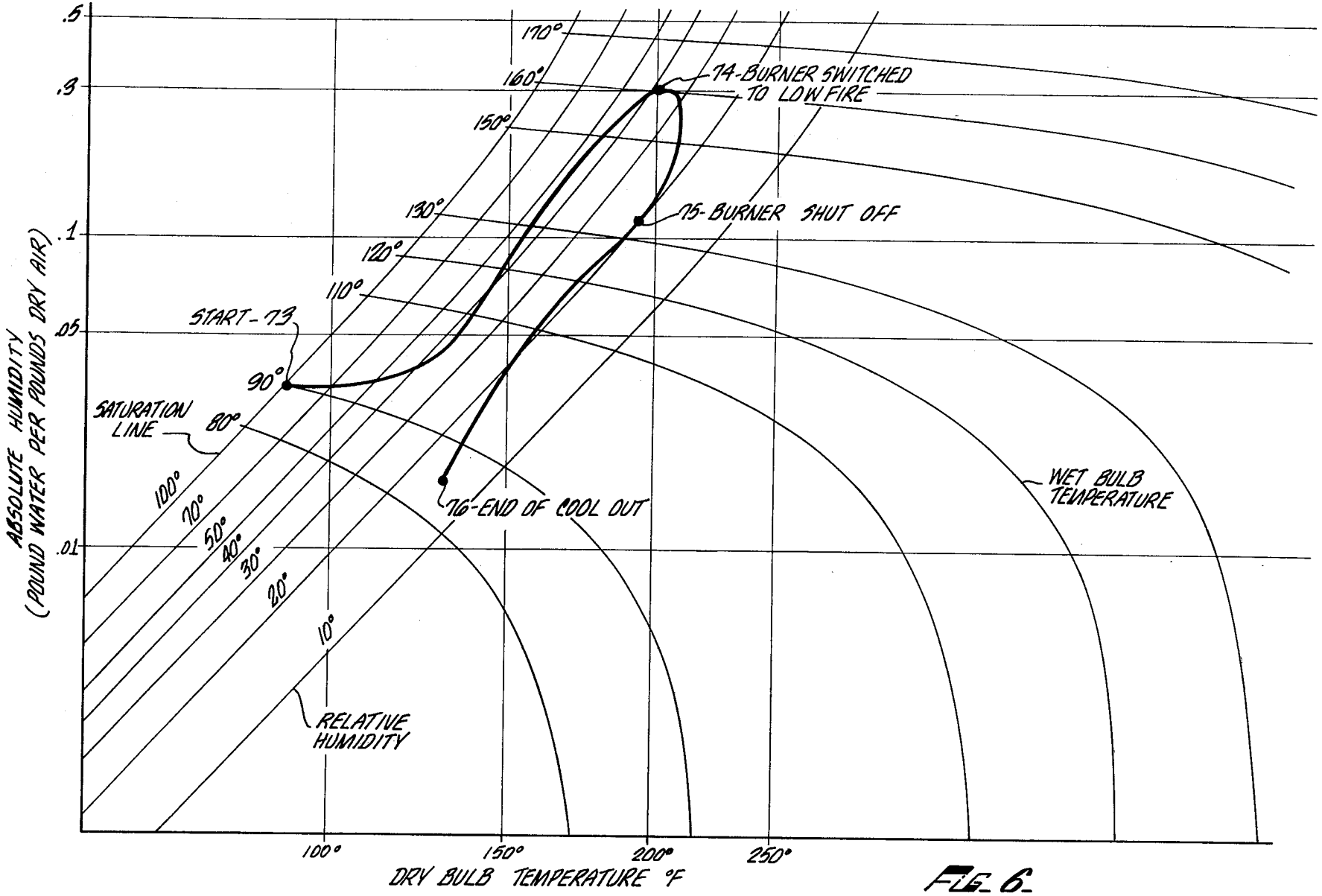

FIG. 6 is a psychrometric chart showing the properties of gas withdrawn from the drying chamber of the dryer of FIG. 1 during the drying of laundry; and FIGS. 7A, 8A, and 9A show various embodiments of lint filters for use in the dryer of FIG. 1 in position for removing contaminants such as lint from recirculating air, and FIGS. 7B, 8B, and 9B show the same filters, respectively, in position for releasing collected contaminants to the atmosphere.

DESCRIPTION

The present invention is directed to methods and apparatus for drying fabrics. By the term "fabrics" there is meant flexible materials which can retain moisture, including, but not limited to synthetic and natural textiles, fibres, filaments, yarns, and the like. There is also included relatively impervious materials such as leather, and cellulosic structures like paper and wood.

Fabrics are dried by introducing a hot drying gas into a drying zone or chamber containing wet fabrics and moisture-laden gas. In the drying chamber moisture is evaporated from the fabrics. The pressure of the moisture-laden gas in the drying chamber is greater than atmospheric pressure so that a portion of the moisture-laden gas can be discharged from the drying chamber directly to the atmosphere. The nondischarged portion of the gas in the drying chamber is withdrawn, and at least a portion of it is recirculated for introduction into the drying chamber. Before it is reintroduced into the drying chamber, the pressure of the withdrawn gas is increased, the gas is heated, and it is combined with a dilution gas in an amount at least sufficient to about equal the amount of gas discharged from the drying zone to reduce the absolute humidity of the withdrawn gas and to make up what is discharged to the atmosphere.

With reference to FIGS. 1 and 2, there is shown a commercial dryer 10 embodying features of the present invention. The dryer includes a rotatable, perforated drum 12 and tiltable main housing 13 such as the main housing shown in U.S. Pat. No. 3,601,903, which is incorporated herein by this reference. The interior of the drum is referred to as a drying chamber 14 herein. An exhaust duct 16 connects the bottom of the main housing 13 with the intake of a main circulating fan or blower 18. The exhaust duct 16 can be provided with a damper 19. The outlet of the fan 18 discharges a gas into a discharge duct 20 which leads into a gas discharge passage 22 contained in a gas flow housing 24. The gas flow housing 24, which is shown in phantom in FIG. 1, is rectangular, and is attached to the top of the discharge duct 20. The housing 24 contains not only the gas discharge passage 22 but also an air make-up passage 26. The two passages 22 and 26 are partially separated by a vertical wall 27 and are interconnected by an opening which is covered with an air filter 28, such as a fine mesh screen of 20 mesh. The gas discharge passage 22 and the make-up air passage 26 are each provided with a valve-like damper 30 and 31, respectively, each damper being operated by an air cylinder 32 and 33, respectively. The gas discharge passage damper 31 is pivotally mounted so as to be able to close off the passage between the gas discharge passage 22 and the air make-up passage 26. The gas discharge passage 30 is pivotally mounted so as to be able to substantially close off the gas discharge passage 22. The make-up air passage 26 is attached to a chamber 34 which can be either ahead of or surrounding a main burner 36 that supplies the bulk of the energy for drying. The gas discharge passage 22 and the air make-up passage 26 can be connected to external ducts 38 and 39, respectively.

The air filter 28, which is used for removing lint from circulating gas, can advantageously be used with a lint disposal apparatus such as the apparatus described in U.S. Pat. No. 3,966,441, which is incorporated herein by this reference. In such an arrangement, the air filter screen 28 is cylindrically shaped within the opening between the gas discharge passage 22 and make-up air passage 26, resolves, and is fitted with a small ribbon-type lint burning burner. The lint burner can provide a portion of the heat required for heating the gas recirculated to the drying zone.

The main burner 36 preferably is a the burner described in U.S. Pat. No. 4,128,388, incorporated herein by this reference. Such a burner is able to operate both on liquid fuels such as fuel oil and gaseous fuels such as natural gas.

A combustion air fan 40 provides air through an outlet duct 42 to the burner 36. Fuel introduced to the burner which is not burned immediately at the burner is consumed in a secondary combustion zone 44. A dryer intake duct 46 brings gases from the chamber 34 surrounding the burner into the housing 13 and then into the drum 12.

The dryer is provided with the housing 13, a safety explosion hatch 50, an access door 52 to the drum 12, and a control panel 54. The housing 13 is provided with at least two vents 56 to the atmosphere and can be provided with live steam injection bars or ports 58. The vents 56 can be no more than random leakage clearances, i.e., "construction clearances" which can result in fabricating the dryer 10 without requiring close tolerances. Thus, specially constructed vents 56 are not required, but instead, random leakage can be relied upon.

There are two basic modes in which the dryer 10 can be operated, a closed loop mode and an open loop mode. The closed loop mode is used for drying. The open loop mode is used primarily for cooling, but can also be used for drying. The configuration of the gas flows in the drying mode are shown in FIGS. 1–3 and the configuration of gas flows in the open loop drying or cooling mode is shown in FIG. 4. During start-up, the dryer is operated in the open loop mode to avoid the possibility of an explosive concentration of gas developing in the dryer if the burner fails to ignite.

In the drying mode, moisture is evaporated from wet fabrics 62 in the drying chamber 14. A portion of the moisture-laden gas in the drying chamber is vented directly to the atmosphere via the moisture vents 56 in the main housing 13. As is more fully described below, such venting directly to the atmosphere does not require suction fans or the like because the drying chamber is operated under positive pressure. By the term "directly to the atmosphere", there is meant that discharge of gas to the atmosphere occurs without passage through ducts, suction fans, and the like, but occurs through portions of the main housing proximate to the drying chamber.

The remainder of the moisture-laden gas in the drying chamber 14 are withdrawn from the chamber 14 by the main circulating fan 18 via the exhaust duct 16. The damper 19 in duct 16 is in the position shown by the solid lines in FIG. 2.

The withdrawn gas is blown by the main circulating fan 18 through the discharge duct 20 into the gas discharge passage 22. The gas discharge damper 30 is maintained in a closed position so that substantially all of the gas discharged by the fan 18 is blown through the filter 28 to remove lint and other contaminants. The damper 31 for the make-up passage 26 can be closed or a small gap such as a $\frac{3}{8}$ inch gap can be left between the damper 31 and the wall of the make-up passage for eduction of air to be combined with the gas recirculated into the drying chamber 14. Hot gaseous combustion products produced by burning of fuel in the burner 36 and the clean gas in the make-up passage 26 are combined in a chamber 34 surrounding the burner 36, and then the combined gas is introduced into the drying chamber 14. The combustion products have a relative humidity that is lower than the relative humidity of the withdrawn gas.

Any fine lint and other combustibles which pass through the filter 28 are consumed by the open flame in the burner 36. This reduces the amount of lint which is recirculated and hence reduces the amount collected on the filer 28 and the amount discharged to the atmosphere.

The term "drying gas" as used herein refers to the hot gas introduced into the drying chamber. As shown in FIG. 1, the drying gas can be a combination of gas withdrawn from the drying chamber, gaseous combustion products of fuel, and air educted through the make up passage 26.

In the drying mode, a small amount of withdrawn gas can be discharged to the atmosphere via the gas discharge passage 22 by opening the damper 30 very slightly, in the order of about ⅜ inch to ½ inch. This is done to maintain the relative humidity of the drying gas introduced to the drying chamber at less than about 10%.

The circulating fan 18 increases the pressure of gas withdrawn from the drying chamber 14 an amount sufficient that (1) the drying gas is at a pressure greater than atmospheric pressure and (2) the pressure of the gas in the drying chamber is maintained greater than atmospheric pressure, and generally at a pressure of up to about 1 to 2 inches of water.

In the open loop mode, as shown in FIG. 4, both the gas discharge passage damper 30 and the air make-up passage 31 damper are open. This permits hot gas withdrawn from the drying chamber to be exhausted to the atmosphere and cool gas to be sucked into the drying chamber via the make-up passage 26 by the circulating fan. The passage of hot gas across the face of the filter 28 creates a low pressure area over the face of the filter which scavenges the lint and other contaminants from the filter. The contaminants are entrained in the discharged gas and passed through the discharge duct 38 to atmosphere or a remote lint collector. This feature of the filter screen is described below in more detail.

After completion of cooling of the fabrics 62 in the drying chamber 14, the gas discharge passage damper 30 and the air make-up passage damper 31 can be closed and the damper 19 in the fan intake duct 16 can be moved to a closed position as shown by dashed line 64 in FIG. 2. The door to the drying chamber is then opened, and the air blown by the fan 18 can blow dried fabric out the door.

The live steam injection bars 58 fitted near the bottom of the rotating drum 12 can be used for localized contact heating of textiles to speed up the heating of the fabric to the moisture evaporation point. Preferably, super-heated steam is used. After cooling of the steam from heat transfer with the textiles, the steam is simply entrained into the circulating gases in the system. High pressure steam from the injection bars 58 can provide an "air-seal" between the housing 13 and the rotating drum 12 to prevent by-pass of circulating drying gas around the drum.

The gas discharge damper 30 and the make-up air damper 31 can be electrically interlocked to flame sensing equipment and combustion controls to insure that the closed loop mode is operational only after and so long as complete combustion is established. Preferably the air filter 28 is provided with pressure sensing equipment so that if the lint screen is plugged, an alarm goes off.

FIG. 5 diagrammatically shows an indirect heated dryer 66 according to the present invention in a closed loop drying mode. Elements in FIG. 5 which are the same as elements in FIGS. 1–4 bear the same reference numerals. The indirect fired dryer 66 differs from the direct fired dryer 10 principally in that the burner 36 is replaced with an indirect heating unit 67. The indirect heating unit 67 can be no more than a plurality of steam or thermal fluid containing tubes, or electric heaters, or the like. Because the burner 36 is not required, the indirect fired dryer 66 does not have a combustion air fan 40. The dryer 66 includes a main housing 80 provided with a cold air door 82.

As shown in FIG. 5, the gas discharge passage 22 and the air make-up passage 26 are completely separated by the wall 27. Each passage 22 and 26 is provided with a damper 68 and 69, respectively, across its base portion. The air make-up passage also has a filter 70 across its base portion and a door 71, which when closed, separates the make-up passage 26 from the atmosphere. The door 71 can serve as an explosion hatch. The dryer 66 is shown in a closed-loop drying mode in FIG. 5. In this mode the damper 68 and cold air door 82 are substantially closed, the filter 70 is across the opening of the air make-up passage, and the door 71 is left slightly open. Thus, gas blown by the fan 18 is cleaned by the filter 70 and educts air past the door 71 into the heating unit 67. Rather than relying on eduction of air into the heating unit 67, a make-up air fan 84 can be used to blow air past the door 71 into the heating unit.

In the cooling mode, the air make-up passage damper 69 is closed and the gas discharge passage damper 68 is opened to pass hot exhaust gases to the atmosphere. The filter 70 can be pivoted to a position across the base portion of the gas air discharge passage 22 for cleaning. The cold air door 82 is opened wide to the position shown by dashed line 83 in FIG. 5. This blocks the discharge from the heater 67 and permits atmospheric air to be sucked by the fans 18 into the drying chamber 14 for cooling of the textiles therein.

Although FIGS. 1–5 only show batch drying, i.e., the drying of a batch of fabrics, the recirculating air system, air filter, and positive pressure operation features of the present invention can all be used with continuous systems such as described in U.S. Pat. Nos. 3,815,287 and 4,010,550, both of which are incorporated herein by this reference.

The psychrometric properties of the gas in the drying chamber are important to the satisfactory operation of the dryers 10 and 66, particularly with regard to efficient usage of fuel. It is important according to the present invention that the dryers be operated at a high level of fuel efficiency, i.e., minimization of the number of BTU's required per pound of water evaporated. It has been determined that if either too little or too much water is evaporated per cubic foot of drying air introduced into the drying chamber, the fuel utilization of the dryer is unsatisfactory. Thus, gas withdrawn from the drying chamber has a relative humidity of at least about 15% and a wet bulb temperature of at least about 140° F. This corresponds to an absolute humidity of about 0.13 pound of water per pound dry air. Also, the relative humidity of the withdrawn gas is no more than about 65% and the wet bulb temperature of the withdrawn gas is no more than about 185° F. These values correspond to an absolute humidity of about 0.8 pound water per pound of dry air. Within these ranges, fuel efficiency is generally satisfactory.

When a temperature is presented herein, there is meant the dry bulb temperature unless indicated otherwise. Also, the term "relative humidity" is defined as the ratio of the amount of water vapor actually present in a gas to the greatest amount possible at the same temperature. The term "absolute humidity" refers to the actual amount of water vapor present in the gas.

Differences have been noted between indirect fired drying and direct fired drying. With indirect fired drying, the temperature of the gas in the drying chamber generally is lower than the temperature of the gas in the drying chamber with direct fired drying. Thus, with indirect fired drying, as compared to direct fired drying, there is more tendency for water vapor in gas withdrawn from the drying chamber to condense on internal, relatively cool surfaces of the dryer. Such condensation has resulted in slippage of the apparatus used for rotating the drum. Also, the lower temperatures tend to cause a lower drying rate. To avoid these problems, in indirect fired drying, preferably the withdrawn gas is maintained at a relative humidity of less than about 65% and a wet bulb temperature of less than about 185° F., corresponding to an absolute humidity of about 0.8 pound water per pound of dry air. On the other hand, with direct fired drying, where these problems do not exist, preferably the withdrawn gas is maintained at a relative humidity of less than about 55% and a wet bulb temperature of less than about 165° F., corresponding to an absolute humidity of about 0.35 pound water per pound dry air.

Differences have also been noted between direct fired drying with oil as the fuel versus direct fired drying with gas as the fuel. When drying with gas, fuel efficiency becomes unsatisfactory when the withdrawn gas has a relative humidity of less than about 35% and a wet bulb temperature of less than about 155° F. Therefore, when drying with gas, preferably the withdrawn gas has a relative humidity of at least about 35% and a wet bulb temperature of at least about 155° F. This corresponds to an absolute humidity of about 0.23 pounds of water per pound of dry air.

When drying with oil, if the withdrawn gas has too high a water content, all of the oil is not consumed in the secondary combustion zone, and a portion of it can condense on the fabrics in the drying chamber. This can result in soiled and smelly fabrics. To avoid this problem, when operating a direct fired dryer using oil, preferably the gas withdrawn from the drying chamber is maintained at a relative humidity of less than about 32% and a wet bulb temperature of less than about 160° F. These values correspond to an absolute humidity of about 0.28 pounds of water per pound of dry air.

FIG. 6 shows the psychrometric properties of withdrawn gas during a complete cycle of direct fired drying using natural gas as the fuel in the dryer of FIG. 1. A test was conducted with about 400 pounds dry weight of laundry having a water retention of about 65%, i.e., the laundry when loaded in the drying chamber contained (400 pounds)×(65%)=260 pounds of water. The laundry was dried in about 13 minutes. The curve in FIG. 6 shows the psychrometric properties of various samples of withdrawn gas during the drying cycle. The samples taken include gas samples at the start, when the firing rate was reduced, when the burner was shut off, and the end of cooling the laundry. These samples are represented by points 73, 74, 75, and 76, respectively on the curve.

As shown by the curve, during the initial portion of the drying cycle, the temperature of the withdrawn gas and the moisture content of the withdrawn gas increased until reaching a maximum. At this maximum, the laundry had given up the bulk of its moisture. Thereafter, the moisture content of the withdrawn gas decreased. As the firing rate was decreased the dry bulb temperature of the withdrawn gas also decreased. Initially, the relative humidity of the withdrawn gas was 100%, but it quickly dropped to about 38% and then during the portion of the drying cycle when the burner was operated at full capacity, it was relatively constant in the range of about 33 to 48%.

The curve in FIG. 6 shows that both absolute humidity and the dry bulb temperature of the withdrawn gas changed during the drying cycle with the relative humidity being maintained relatively constant at a selected range once it stabilized after the initial start-up.

As noted above, the withdrawn gas is subjected to three process steps before it is reintroduced as drying gas into the drying chamber. First, the pressure is increased by the fan 18 to compensate for pressure drops in the system and to maintain the pressure in the drying chamber greater than atmospheric. As the second and third steps, the withdrawn gas is heated and combined with a dilution gas. It is heated in a sufficient amount so that the drying gas has a temperature of at least about 300° F. The higher the temperature of the drying gas, the better for rapid drying. Thus, preferably the drying gas has a temperature of at least about 450° F. However, at temperatures higher than about 600° F., damage to fabrics, and in particular, damage to synthetic fabrics, can occur. Therefore, preferably the drying gas is maintained at a temperature of less than about 600° F.

The drying gas is combined with a dilution gas to reduce its absolute humidity. The dilution gas replenishes the gas discharged directly from the drying chamber to the atmosphere, and that gas, if any, discharged via the air discharge passage 22. In the indirect drying process, as shown in FIG. 5, all of the dilution gas is make-up air educted through the make-up air passage 26. If necessary, external assistance means such as the small fan 84 can be used for providing the make-up air.

In a direct fired drying process, preferably the bulk, and more preferably, all of the dilution gas is provided by the combustion products of the fuel with air. A small amount of make-up air can be educted as dilution gas through the make-up air passage 26 by leaving a small gap between the make-up air damper 31 and the walls of the make-up air passage 26. A gap in the order of about $\frac{3}{8}$ inch has found to be satisfactory. In such an operation, the dilution gas includes both the combustion products and educted air.

Preferably, the dilution gas comprise at least about 5% by volume of the drying gas introduced into the drying chamber. If less than about 5% dilution gas is used, then the gas in the drying chamber has such a high moisture content that the drying rate becomes unsatisfactorily low and the fuel usage unsatisfactorily high. Furthermore, when using direct fired drying with oil as the fuel, if the dilution gas constitutes less than about 5% of the drying gas, then oil condensation resulting in soiled and foul smelling fabrics in the drying chamber can result. It is necessary to dilute a sufficient amount when burning oil to avoid oil condensation on the fabrics in the drying chamber. On the other hand, preferably the dilution gas comprises at most about 20%, and more preferably at most about 10% of the drying gas introduced into the drying chamber. At dilution levels of more than 10%, and particularly at more than about 20%, excessive amounts of energy are required for bringing the drying gas up to sufficiently high temperatures of at least about 300° F. for introduction into the drying chamber. Furthermore, if the dilution gas comprises more than about 10% of the gas introduced into the drying chamber, it is difficult to maintain positive pressure in the drying chamber without using a supplementary fan for blowing in make-up air. Therefore, the dilution gas comprises from about 5 to about 20%, and more preferably from about 5 to about 10% by volume of the drying gas.

The relative humidity of the drying gas is low for rapid drying of the fabrics in the drying chamber. Preferably the relative humidity of the drying gas is less than about 10%, and generally in the range of from about 0.15 to about 10%. It is undesireable to have the relative humidity of the drying gas be less than about 0.15% because to achieve this low value, so much dilution gas is required, excessive amounts of fuel are required for heating the dilution gas.

The preferred method for controlling the operation of the driers 10 and 66 is to monitor the temperature of the gas withdrawn from the drying chamber. If the temperature of the withdrawn gas is higher than desired, the rate at which fuel is burned is decreased. If the temperature is lower than desired, the rate of which fuel is burned is increased.

As shown in FIG. 4, in the open loop mode, lint is blown from the lint screen. As is more clearly shown in FIGS. 3 and 4, preferably the gas air discharge passage 22 is narrower across its base or throat 80 than it is in the vicinity 82 of the filter 28 and the filter is recessed relative to the entrance. This results in the gas discharged via the gas discharge passage creating a vacuum across the face of the filter. This vacuum assists in scrubbing contaminants from the filter for discharge to the atmosphere or collection.

Three other embodiments of filters according to the present invention are shown in FIGS. 7–9, with FIGS. 7A, 8A, and 9A showing the three embodiments in a lint collecting mode with the dryer operated in a closed loop mode, and FIGS. 7B, 8B, and 9B showing the respective filters in a lint release mode when the dryer is operating in an open loop mode.

The filter 83 shown in FIG. 7A is a rotating cylindrical drum filter built into the wall 27 separating the gas discharge passage 22 from the make-up air passage 26. A damper 84 for the make-up air passage is curved so as to conform to the outer wall of the filter 83 so that passage of gas between the discharge and make-up passages can be prevented.

The filter 86 shown in FIG. 8 is a slidable filter that fits across either the air discharge passage 22 or the make-up air passage 26. The position of the filter is controlled by an air or hydraulic fluid mechanism 86.

The filter 88 shown in FIG. 9 is substantially the same as the one shown in FIGS. 3 and 4, except that it is pivotally mounted on the separating wall 27 so that is can be pivoted into position across the air discharge passage 22 (FIG. 9B) so that all gas discharged through this passage can sweep contaminants from the filter.

The process and apparatus of the present invention have many advantages compared to prior art processes and apparatuses. For example, excellent fuel utilization is achieved. Operation of a dryer according to the present invention in the closed loop mode with steam coil heat required only about 2,000 BTUs to evaporate a pound of water, compared to 4,500 BTUs per pound of water for a conventional open loop system. This amounts to a 55% reduction in fuel requirements.

When operating the direct fired dryer of FIG. 1, it has been determined that as little as 1,650 BTUs are required per pound of water evaporated. Since the minimum practical heat required to evaporate water in a dryer is about 1,500 BTUs per pound, the dryer of the present invention can achieve the startling high efficiency of about 90%. For direct fired dryers, improvements of 25% are easily obtainable. For a 400 pound load having a 65% water retention, the energy savings can amount to 138,000 BTUs.

In addition to fuel savings, other advantages of the apparatus and method of the present invention have been noticed. For example, because of the moisture content of the drying gas, there is a reduced tendency to scorch the surfaces of textiles in the drying chamber. Furthermore, it has been noticed that the fabrics in the drying chamber have a "softer touch" due to the presence of moisture in the drying gas.

Other important advantages result from the use of positive pressure in the drying chamber. Because of this pressure, more uniform drying occurs, with all surface areas of the fabrics being available for drying. Because of the positive pressure in the dryer, surface evaporation is improved due to the "omni-directional" gas leakage from the drying chamber which carriers off moisture in all directions, whereas negative pressure systems tend to release surface moisture only in the direction of circulating air flow. By the term "omni-directional", there is meant that gas is discharged from the drying zone in a plurality of directions. This is particularly important in drying impervious materials such as hides, skins, synthetics, and the like. In addition, uniform drying is obtained due to the positive pressure in the drying chamber because inward leakage of air is prevented, and thus cold air stratification in the drying chamber is avoided.

Compared to conventional open loop drying systems, the quantity of make-up air required is reduced substantially. This reduces building heating and ventilation requirements. Also, air circulation rate through the fabrics being dried can be improved. In some open loop operations, large quantities of make-up air often are not available and the dryer is literally starved for make-up air.

Another advantage of the closed loop system is that the gas vented from the drying chamber generally has an absolute humidity greater than about 0.15 pounds of water per pound of dry air. This is sufficiently high that the psychrometric properties of the gas withdrawn from the drying chamber and/or the gas discharged from the drying chamber can be monitored as an indication of the progress of the drying process. The highly saturated condition of the small amount of vented air obtained with the process of the present invention is much more indicative of the moisture content of the fabrics within the drying chamber than is the large volume of relatively dry discharge air obtained in conventional open loop systems. Thus, the moisture content of gas discharged and/or withdrawn from the drying chamber can be determined during the drying process, and the heating of withdrawn gas can be substantially automatically terminated by appropriate control apparatus when the moisture content of the gas reaches a preselected value.

Another advantage of the positive pressure system is that conventional mechanical wipers or baffles normally used in the rotating drying chamber to prevent by-pass of circulating drying air around the drying chamber are not required.

These and other advantages to the present invention will become better understood from the following examples.

EXAMPLE 1

Four hundred pounds of laundry having a water retention of 65% were dried in the direct fired dryer of FIG. 1 using about 44 SCFM maximum rate of natural gas and 500 SCFM of air. Drying gas was introduced to to the drying chamber at a rate of about 7,000 SCFM. Thus, the dilution gas amounted to about 7.8% (544/7000×100) of the drying gas. The total energy requirements were about 408 SCFM of natural gas.

EXAMPLE 2

The test of Example 1 was duplicated except that the natural gas was replaced with No. 1 fuel oil having an energy content of 137,000 BTUs per gallon. Fuel oil was burned at a maximum rate of 20 gallons per hour with 550 SCFM of air. The laundry took about 13 minutes to dry and required a total of 3.13 gallons of fuel oil.

Although the present invention has been described in considerable detail with reference to certain versions thereof, other versions are possible. For example, all the dryers shown in the figures use drying gas entering the top of the drying chamber. However, the present invention is useful with a bottom entry "up blast" drying gas dryers and other configurations, including "omni-directional" air flow.

In addition, the gas flow housing 24, which contains the gas discharge passage 22, air make-up passage 26, air filter 28, and valve-like dampers, can be located remotely from the dryer 10 or 66 by suitable interconnecting duct work. Exemplary of this concept is a roof mounted gas flow housing 24.

Furthermore, the method for evaporation of the moisture described herein can be enhanced by rapid intermittent full exchange of circulating gas to the atmosphere in lieu of or in combination with the previously described constant bleed method. During these quick intermittent exchanges, which last from only about 5 to about 20 seconds, the closed loop apparatus dampers can be switched so as to create a vacuum effect to improve the operation. On direct fired units, the burner can be shut off if a vacuum purge system is used. During these quick intermittent exchanges, the psychrometric properties and temperature of the drying gas and the gas in the drying zone can, for short periods, be outside the ranges specified above. Thus, it should be realized that the psychrometric properties and temperatures presented herein are time averaged values.

In addition to using the apparatus and method of the present invention for drying of fabrics, they can also find application in bulking, dye setting, heat-setting, relaxing, shrinking, and the like.

In view of these modifications, the spirit and scope of the present invention should not be limited to the description of the preferred versions described herein.

What is claimed is:

1. A method for drying fabrics comprising the steps of:

(a) introducing a hot drying gas into a drying zone containing wet fabrics and moisture-laden gas, the drying gas being maintained at a sufficiently high temperature of from about 300° to about 600° F., a sufficiently low relative humidity of less than about 10%, and a sufficiently high pressure greater than atmospheric pressure so that (i) moisture is evaporated from the fabrics, (ii) the pressure of the moisture-laden gas in the drying zone is greater than atmospheric pressure, and (iii) the relative humidity of the moisture-laden gas in the drying zone is from about 15% to about 65%;

(b) tumbling the fabrics in the drying zone;

(c) discharging a portion of the moisture-laden gas from the drying zone directly to the atmosphere;

(d) withdrawing the remainder of the moisture-laden gas from the drying zone; and (e) forming the hot drying gas by the steps of (i) increasing the pressure of the withdrawn gas, (ii) heating the withdrawn gas, and (iii) combining the withdrawn gas with a dilution gas in an amount sufficient to about equal the amount of moisture-laden gas discharged from the drying zone, said amount of dilution gas which is combined with the withdrawn gas comprising from about 5 to about 20% by volume of the hot drying gas introduced into the drying zone.

2. The method of claim 1 wherein the steps of heating the withdrawn gas and combining the withdrawn gas with a dilution gas comprise the steps of burning a fuel with a source of oxygen to produce hot gaseous combustion products and combining the withdrawn gas with hot gaseous combustion products, said hot gaseous combustion products having a relative humidity lower than the relative humidity of the withdrawn gas.

3. The method of claim 2 in which the step of combining the withdrawn gas with a dilution gas also includes the step of educting air into the withdrawn gas after the pressure of the withdrawn gas is increased.

4. The method of claim 1 in which the step of combining the withdrawn gas with dilution gas comprises educting air into the withdrawn gas after the pressure of the withdrawn gas is increased.

5. The method of claim 1 in which the steps of heating the withdrawn gas and combining the withdrawn gas with a dilution gas comprises burning a fuel with a source of oxygen to produce hot gaseous combustion products and combining the withdrawn gas with substantially only the hot gaseous combustion products.

6. The method of claim 5 in which the relative humidity of the moisture-laden gas in the drying zone is maintained at less than about 55%.

7. The method of claim 1 including the step of discharging to the atmosphere a portion of the gas withdrawn from the drying zone, wherein the amount of dilution gas which is combined with the withdrawn gas is sufficient to about equal the amount of moisture-laden gas discharged from the drying zone in combination with the amount of withdrawn gas discharged to the atmosphere.

8. The method of claim 1 in which the step of combining the withdrawn gas with dilution gas comprises intermittently combining the withdrawn gas with atmospheric air.

9. The method of claim 1 in which the withdrawn gas contains lint and including the step of removing lint from at least a portion of the withdrawn gas before the withdrawn gas is reintroduced to the drying zone as hot drying gas.

10. A method for drying fabrics comprising the steps of:

(a) introducing a hot drying gas into a drying zone containing wet fabrics and moisture-laden gas, the drying gas being maintained at a sufficiently high temperature of from about 300° to about 600° F., a sufficiently low relative humidity of less than about 10%, and a sufficiently high pressure greater than atmospheric pressure so that (i) moisture is evaporated from the fabrics, (ii) the pressure of the moisture-laden gas in the drying zone is greater than atmospheric pressure, and (iii) the relative humidity of the moisture-laden gas in the drying zone is from about 15% to about 65%;

(b) tumbling the fabrics in the drying zone;

(c) discharging a portion of the moisture-laden gas from the drying zone directly to the atmosphere;

(d) withdrawing the remainder of the moisture-laden gas from the drying zone; and (e) forming the hot drying gas by the steps of (i) increasing the pressure of the withdrawn gas, (ii) heating the withdrawn gas, and (iii) combining the withdrawn gas with a dilution gas in an amount sufficient to about equal the amount of moisture-laden gas discharged from the drying zone, wherein the amount of dilution gas which is combined with the withdrawn gas comprises from about 5 to about 10% by volume of the hot drying gas introduced into the drying zone.

11. The method of claim 1 wherein a batch of fabrics is dried in the drying zone and the relative humidity of the moisture-laden gas in the drying zone varies during the drying of the batch.

12. The method of claim 11 in which the relative humidity of the drying gas is varied during the drying of the batch.

13. The method of claim 1 wherein a batch of fabrics is dried in the drying zone and the relative humidity of the drying gas is varied during the drying of the batch.

14. A method for drying fabrics comprising the steps of:

(a) introducing a hot drying gas into a drying zone containing wet fabrics and moisture-laden gas, the drying gas being maintained at a sufficiently high temperature of from about 300° to about 600° F., a sufficiently low relative humidity of less than about 10%, and a sufficiently high pressure greater than atmospheric pressure so that (i) moisture is evaporated from the fabrics, (ii) the pressure of the moisture-laden gas in the drying zone is greater than atmospheric pressure, and (iii) the relative humidity of the moisture-laden gas in the drying zone is from about 15% to about 65%;

(b) tumbling the fabrics in the drying zone;

(c) discharging a portion of the moisture-laden gas in a plurality of directions from the drying zone directly to the atmosphere;

(d) withdrawing the remainder of the moisture-laden gas from the drying zone; and (e) forming the hot drying gas by the steps of (i) increasing the pressure of the withdrawn gas, (ii) heating the withdrawn gas, and (iii) combining the withdrawn gas with a dilution gas in an amount sufficient to about equal the amount of moisture-laden gas discharged from the drying zone, said amount of dilution gas which is combined with the withdrawn gas comprising from about 5 to about 20% by volume of the hot drying gas introduced into the drying zone.

15. The method of claim 1 including the steps of determining the moisture content of moisture-laden gas discharged from the drying zone and terminating the step of heating the withdrawn gas when such a determined moisture content is at a preselected value.

16. The method of claim 1 including the steps of determining the moisture content of moisture-laden gas withdrawn from the drying zone and terminating the step of heating the withdrawn gas when such a determined moisture content is at a preselected value.

17. A method for drying fabrics comprising the steps of:

(a) introducing a hot drying gas into a drying zone containing wet fabrics and moisture-laden gas, the drying gas being maintained at a sufficiently high temperature of from about 300° to about 600° F., a sufficiently low relative humidity of less than about 10%, and a sufficiently high pressure greater than atmospheric pressure so that (i) moisture is evaporated from the fabrics, (ii) the pressure of the moisture-laden gas in the drying zone is greater than atmospheric pressure, and (iii) the relative humidity of the moisture-laden gas in the drying zone is from about 15% to about 65%;

(b) tumbling the fabrics in the drying zone;

(c) discharging a portion of the moisture-laden gas from the drying zone directly to the atmosphere;

(d) withdrawing the remainder of the moisture-laden gas from the drying zone;

(e) forming the hot drying gas by the steps of (i) increasing the pressure of the withdrawn gas, (ii) heating the withdrawn gas, and (iii) combining the withdrawn gas with a dilution gas in an amount of sufficient to about equal the amount of moisture-laden gas discharged from the drying zone, said amount of dilution gas which is combined with the withdrawn gas comprising from about 5 to about 20% by volume of the hot drying gas introduced into the drying zone; and (f) introducing steam into the drying zone so as to directly contact fabrics in the drying zone.

18. A continuous method for drying fabrics comprising the steps of:

(a) forming a drying gas having a temperature of from about 300° to about 600° F., a relative humidity of less than about 10%, and a pressure greater than atmospheric pressure;

(b) introducing the hot drying gas into a drying zone containing wet fabrics and moisture-laden gas;

(c) tumbling the fabrics in the drying zone;

(d) maintaining the pressure of the gas in the drying zone at greater than atmospheric pressure;

(e) releasing a portion of the gas in the drying zone directly to the atmosphere;

(f) withdrawing gas in the drying zone from the drying zone; and (g) recirculating at least about 80% of the withdrawn gas back into the drying zone.

19. The method of claim 18 including treating at least a portion of the withdrawn gas before it is recirculated to the drying zone by the steps of (i) increasing the pressure of the withdrawn gas; (ii) heating the withdrawn gas, and (iii) combining the withdrawn gas with a dilution gas in an amount at least about equal to the amount of gas released from the drying zone.

20. The method of claim 19 wherein the amount of dilution gas which is combined with the withdrawn gas comprises from about 5 to about 20% by volume of the hot drying gas introduced into the drying zone.

21. The method of claim 19 wherein the amount of dilution gas which is combined with the withdrawn gas comprises from about 5 to about 10% by volume of the hot drying gas introduced into the drying zone.

22. The method of claim 19 in which the step of combining the withdrawn gas with a dilution gas also includes the step of educting air into the withdrawn gas after the pressure of the withdrawn gas is increased.

23. The method of claim 18 in which the step of releasing comprises releasing a portion of the gas in the drying zone in a plurality of directions from the drying zone directly to the atmosphere.

24. The method of claim 19 including the steps of determining the moisture content of gas released to the atmosphere and terminating the step of heating the withdrawn gas when such a determined moisture content is at a preselected value.

25. The method of claim 19 including the steps of determining the moisture content of gas withdrawn from the drying zone and terminating the step of heating the withdrawn gas when such a determined moisture content is at a preselected value.

26. The method of claim 19 in which the steps of heating the withdrawn gas and combining the withdrawn gas with a dilution gas comprise burning a fuel with a source of oxygen to produce hot gaseous combustion products and combining the withdrawn gas with substantially only the hot gaseous combustion products.

27. A method for drying fabrics comprising the steps of:

(a) introducing a hot drying gas into a drying zone containing wet fabrics and moisture-laden gas;
(b) tumbling the fabrics in the drying zone;
(c) maintaining the drying gas at a sufficiently high temperature of from about 400° to about 600° F., a sufficiently low relative humidity of from about 0.15 to about 10%, and a sufficiently high pressure greater than atmospheric pressure that (i) moisture is evaporated from the fabrics, (ii) the pressure of the moisture-laden gas in the drying zone is greater than the atmospheric pressure, and (iii) the relative humidity of the moisture-laden gas in the drying zone is less than about 55%;
(d) discharging a portion of the moisture-laden gas from the drying zone directly to the atmosphere;
(e) withdrawing moisture-laden gas from the drying zone; and
(f) forming the hot drying gas by the steps of (i) increasing the pressure of the withdrawn gas, (ii) burning a fuel with a source of oxygen to form hot gaseous combustion products, and (iii) combining the withdrawn gas with a dilution gas comprising the hot gaseous combustion products, said amount of dilution gas which is combined with the withdrawn gas comprising from about 5 to about 20% by volume of the hot drying gas introduced into the drying zone and being sufficient to at least equal the amount of moisture-laden gas discharged from the drying zone.

28. The method of claim 27 wherein the dilution gas consists essentially of hot gaseous combustion products.

29. The method of claim 27 in which the step of combining the withdrawn moisture-laden gas with a dilution gas also includes the step of educting air into the withdrawn gas after the pressure of the withdrawn gas is increased.

30. The method of claim 27 in which the dilution gas comprises air.

31. The method of claim 27 wherein the fuel is fuel oil and the relative humidity of the moisture-laden gas is maintained sufficiently low that the fabrics are not discolored by fuel oil.

32. The method of claim 27 or 29 including the step of discharging to the atmosphere a portion of the gas withdrawn from the drying zone, wherein the amount of dilution gas which is combined with the withdrawn gas is sufficient to about equal the amount of moisture-laden gas discharged from the drying zone in combination with the amount of withdrawn gas discharged to the atmosphere.

33. The method of claim 27 wherein the amount of dilution gas which is combined with the withdrawn gas comprises from about 5 to about 10% by volume of the hot drying gas introduced into the drying zone.

34. The method of claim 27 wherein the step of discharging comprises discharging gas in a plurality of directions from the drying zone directly to the atmosphere.

35. A method for drying fabrics comprising the steps of:

(a) introducing a hot drying gas into a drying zone containing wet fabrics and moisture-laden gas;
(b) tumbling the fabrics in the drying zone;
(c) maintaining the drying gas at a sufficiently high temperature of from about 400° to about 600° F., a sufficiently low relative humidity of from about 0.15 to about 10%, and a sufficiently high pressure greater than atmospheric pressure that (i) moisture is evaporated from the fabrics, (ii) the pressure of the moisture-laden gas in the drying zone is greater than the atmospheric pressure, and (iii) the relative humidity of the moisture-laden gas in the drying zone is less than about 55%;
(d) discharging a portion of the moisture-laden gas from the drying zone directly to the atmosphere;
(e) withdrawing moisture-laden gas from the drying zone, the relative humidity of the gas withdrawn from the drying zone being from about 15 to about 32%; and
(f) forming the hot drying gas by the steps of (i) increasing the presence of the withdrawn gas, (ii) burning fuel oil with a source of oxygen to form hot gaseous combustion products, and (iii) combining the withdrawn gas with a dilution gas comprising the hot gaseous combustion products, said amount of dilution gas which is combined with the withdrawn gas comprising from about 5 to about 20% by volume of the hot drying gas introduced into the drying zone and being sufficient to at least equal the amount of moisture-laden gas discharged from the drying zone.

36. The method of claim 27 wherein the fuel is gaseous and the relative humidity of the gas withdrawn from the drying zone is from about 35 to about 55%.

* * * * *